US005200722A

United States Patent [19]

Wolf

[11] Patent Number: 5,200,722

[45] Date of Patent: Apr. 6, 1993

[54] MICROWAVE WINDOW ASSEMBLY

[75] Inventor: David Wolf, Clawsen, Mich.

[73] Assignee: United Solar Systems Corporation, Troy, Mich.

[21] Appl. No.: 800,160

[22] Filed: Nov. 27, 1991

[51] Int. Cl.[5] ..... H01P 1/08

[52] U.S. Cl. ..... 333/252; 333/99 PL

[58] Field of Search ..... 333/252, 99 PL

[56] References Cited

U.S. PATENT DOCUMENTS

| | | | |
|---|---|---|---|
| 4,286,240 | 8/1981 | Shively | 333/252 |
| 4,371,854 | 2/1983 | Cohn | 333/252 |
| 4,458,223 | 7/1984 | Schmidt | 333/252 |
| 4,620,170 | 10/1086 | Lavering | 333/252 |
| 4,729,341 | 3/1988 | Fournier | 118/723 |
| 4,931,756 | 6/1990 | Doehler | 333/252 |

FOREIGN PATENT DOCUMENTS

| | | | |
|---|---|---|---|
| 209032 | 1/1957 | Australia | 333/252 |

*Primary Examiner*—Paul Gensler
*Attorney, Agent, or Firm*—Krass & Young

[57] ABSTRACT

A microwave window assembly for transmitting high power microwave energy from microwave propagating means into the interior of a chamber and including first and second windows formed of a dielectric material substantially transparent to microwave energy with the first window sealed in a wall of the chamber and the second window spaced rearwardly from the first window to define a space therebetween. A cooling fluid is circulated in the space between the windows to cool the window positioned in the wall of the vacuum chamber and a waveguide tube extends from the microwave propagating means to the rear surface of the second window to define a waveguide surface extending from the microwave source to the rear surface of the second window. A clamp plate positioned against the forward surface of the second window includes a window which defines a forward extension of the waveguide surface extending forwardly into the space between the windows to a location proximate the rearward surface of the window positioned in the wall of the vacuum chamber. The second window extends radially outwardly beyond the waveguide surface to define an annular outer window portion outwardly of the waveguide surface and the window assembly further includes a seal plate positioned against the rearward surface of the second window and defining an annular groove confronting the rear surface of the outer annular portion of the second window. An elastomeric annular seal is received in the groove and sealingly engages the rear surface of the outer annular window portion.

21 Claims, 4 Drawing Sheets 22b
20b
56
60
12b
62
64
36
20f
20
19
80a
28a
4
12a
20f
50
40
54
20c
20d
32
22f
52
22
22a
22c
46
28b
34
34e
28
24b
30
70
34c
26b
30d
26
26a
24b
24
66
34b
3
24a
26c
28h
22c
22g
20g 4
20e
58

22c 22b
22e
22a
22d

MICROWAVE WINDOW ASSEMBLY

FIELD OF THE INVENTION

This invention relates generally to an apparatus for depositing or etching film through the use of a microwave initiated plasma and more particularly to a microwave plasma deposition apparatus employing an improved window assembly adapted to uniformly transmit high power microwave energy from a source such as a waveguide into the interior of a vacuum deposition-/etch chamber.

BACKGROUND OF THE INVENTION

This invention window assembly has general applicability to any type of apparatus which requires the introduction of high power microwave energy from a source such as a waveguide or antenna, maintained at substantially atmospheric pressure, into the interior of a vacuum chamber, maintained at subatmospheric pressure. The microwave energy is introduced into the vacuum chamber for effecting a glow discharge plasma which is utilized to either deposit a semiconductor or insulating material onto the exposed surface of a substrate or to remove (etch) material from that exposed surface. Whereas the invention window assembly has universal applicability to microwave apparatus, the invention window assembly is especially applicable to the fabrication of photo responsive alloys and devices for various photoconductive applications including the fabrication of electrophotographic photo receptors. Alternatively, the invention window assembly may be employed with equal advantage in association with a vacuum chamber adapted to etch or otherwise treat or modify the surface of a substrate.

Regardless of the type of microwave plasma operation (deposition or etch) being conducted, the rate at which that operation occurs can be controlled, inter alia, by controlling the power at which the microwave energy is transmitted into the interior of the vacuum chamber. In order to deposit or etch at a high rate, it is necessary to utilize high power levels, for example in the kilowatt range and preferably three or more kilowatts. However, the use of such high power microwave energy tends to cause heating of the dielectric window through which the microwave energy is coupled into the interior of the vacuum chamber, and prolonged or excessive heating of the dielectric window can cause cracking of the window with resultant catastrophic failure of the deposition/etch operation. Further, even the introduction of relatively low microwave power into the vacuum chamber over a relatively lengthy period of time can also cause the dielectric window to overheat and fail.

In an effort to overcome failure of the dielectric window due to overheating, it has previously been proposed to position a second window rearwardly of the window in the vacuum chamber wall and pass a cooling fluid between the two windows so as to reduce the temperature of the window positioned in the wall of the vacuum chamber to an acceptable level to allow the introduction of high power microwave energy into the vacuum chamber through the window without producing failure of the window even over extending periods of operation.

However, the spaced dual window arrangement creates problems with respect to coupling the microwave energy into the vacuum chamber since the waveguide surface transmitting the microwave energy from the microwave propagating means extends only to the rear or outboard surface of the second window so that the microwave energy thereafter moves in an uncontrolled manner into the vacuum chamber with the result that the shape and dimensions of the microwave energy in the space between the rear surface of the second window and the vacuum chamber become promiscuous and uncontrolled with the result that the microwave energy spreads out as it enters the vacuum chamber. This promiscuous spreading and deterioration of the form and dimensions of the microwave energy substantially derogates the efficiency of the deposition or etching operation taking place within the vacuum chamber and also severely complicates the task of providing a seal as between the waveguide surface and the cooling fluid circulating between the spaced windows since the randomly and promiscuously moving microwave energy will attack and ultimately destroy anything other than very expensive and very exotic seal arrangements.

More specifically, if an elastomeric or O-ring type seal is employed to seal the cooling fluid from the interior of the waveguide, the promiscuous microwave energy moving between the rear surface of the second window and the vacuum chamber causes a capacitive effect to develop in the vicinity of the elastomeric seal and the discharge activity resulting from the capacitive build-up interferes with the deposition/etching process and also derogates the elastomeric seal.

Accordingly, a need exists for an improved and inexpensive window assembly which can efficiently, economically, reliably and safely transmit relatively high power microwave energy from a waveguide into a vacuum chamber even over extended periods of use.

SUMMARY OF THE INVENTION

The invention window assembly is of the type intended for transmitting high power microwave energy from microwave propagating means into the interior of a vacuum chamber and including first and second windows formed of a dielectric material substantially transparent to microwave energy with the first window adapted to be sealed in a wall of the chamber and the second window spaced rearwardly from the first window to define a space therebetween; means for circulating a cooling fluid in the space between the windows; and means defining an axially extending waveguide surface for transmitting the microwave energy from the propagating means to the window assembly. According to the invention, the waveguide surface includes a first portion comprising a closed surface of substantially uniform cross section extending from a location rearwardly of the second window to a location proximate the rearward surface of the second window and a second portion, corresponding in size and cross-sectional configuration to the first portion, extending from the forward surface of the second window and into the space between the windows toward the rearward surface of the first window. This arrangement extends the waveguide surface to a location proximate the rear surface of the window positioned in the wall of the microwave chamber so as to minimize breakdown in the size and shape of the microwave energy as the microwave energy moves through the chamber window and into the vacuum chamber and thereby minimize derogation of the efficiency of the deposition/etching process taking place within the chamber and minimize sealing problems caused by promiscuously wandering microwave energy.

According to a further feature of the invention, the second window extends radially outwardly beyond the waveguide surface to define an annular outer window portion outwardly of the waveguide surface, and the window assembly includes annular sealing means which coact with the annular window portion to seal the interior of the waveguide surface from the circulating fluid. This specific arrangement places the sealing means out of harms way with respect to the microwave energy and simplifies the provision of an adequate sealing means.

According to a further feature of the invention, the window assembly includes means defining an annular groove confronting a side surface of the annular window portion, and the annular sealing means comprises an elastomeric annular seal received in the annular groove and sealingly engaging the confronting side surface of the annular window portion. This specific arrangement allows the use of an inexpensive elastomeric sealing member to provide the required sealing action.

According to a further feature of the invention, the window assembly includes a housing structure mounting the first and second windows and a seal plate positioned within the housing structure rearwardly of the second window, and the annular groove receiving the annular seal is defined in the forward surface of the seal plate. This specific construction further facilitates the provision of an effective and yet inexpensive seal.

According to a further feature of the invention, the window assembly further includes an annular clamp plate positioned against the forward surface of the second window and the clamp plate includes a central window defining the second waveguide surface portion. This specific arrangement provides a simple and effective means for firmly locking the second window within the housing structure and concomitantly defining the portion of the waveguide surface extending forwardly from the forward surface of the second window.

According to a further feature of the invention, the housing structure includes inner and outer telescopically arranged sleeves and the means for circulating a cooling fluid between the windows includes means defining a cooling fluid path extending axially between the sleeves and communicating at its forward end with the space between the windows. In the disclosed embodiment of the invention, the cooling path includes first and second path portions communicating with the space between the windows respectively at generally diametrically opposed locations so as to allow the delivery of cooling fluid to the space through one path portion and the removal of cooling fluid from the space through the other path portion.

DETAILED DESCRIPTION OF THE PREFERRED EMBODIMENT

Figures 1, 3:
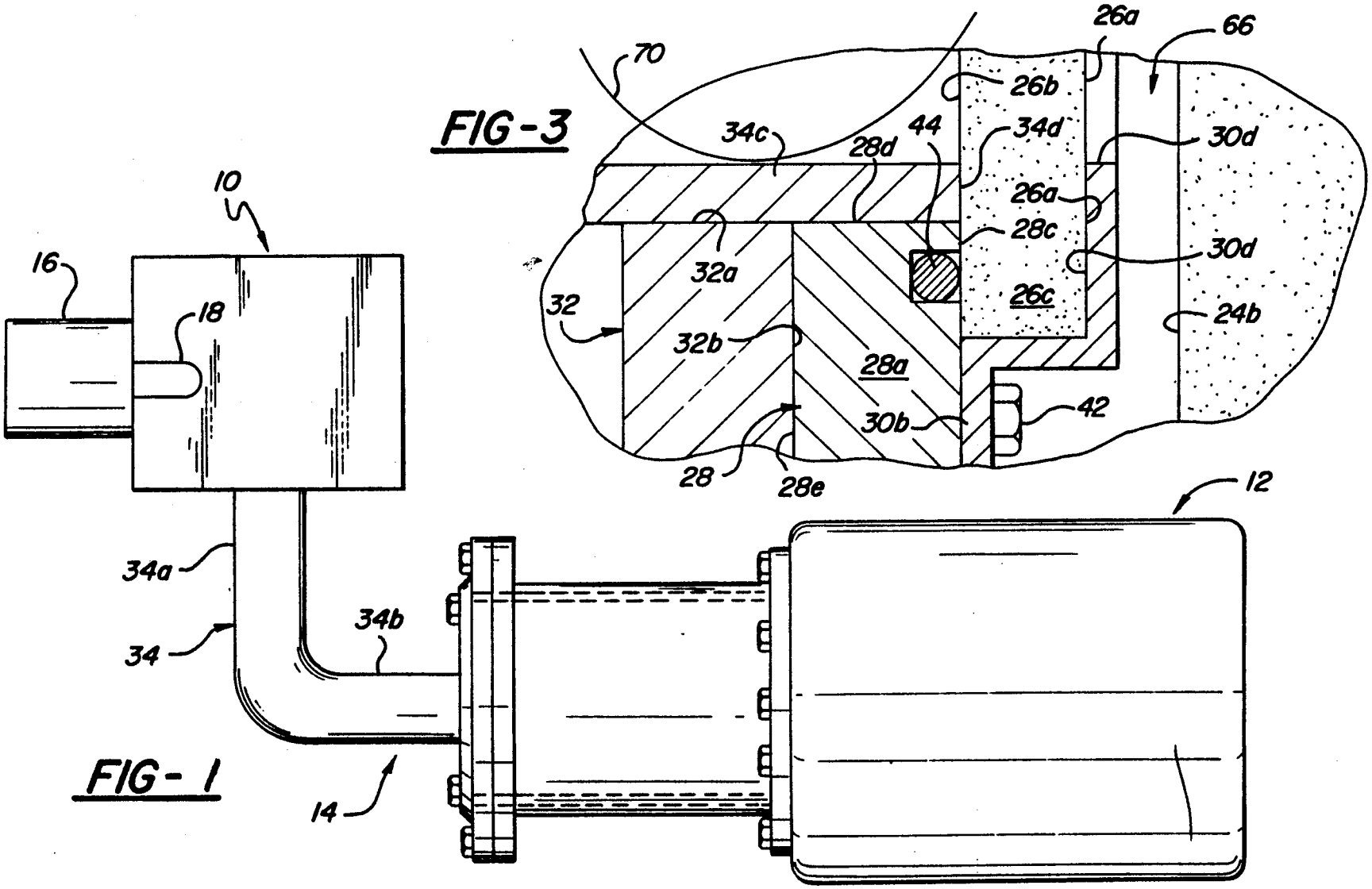
FIG. 1 is a view of a microwave initiating glow discharge deposition apparatus employing the improved window assembly of the invention.
FIG. 3 is an enlarged view taken within the circle 3 of FIG. 2.
Figure 2:
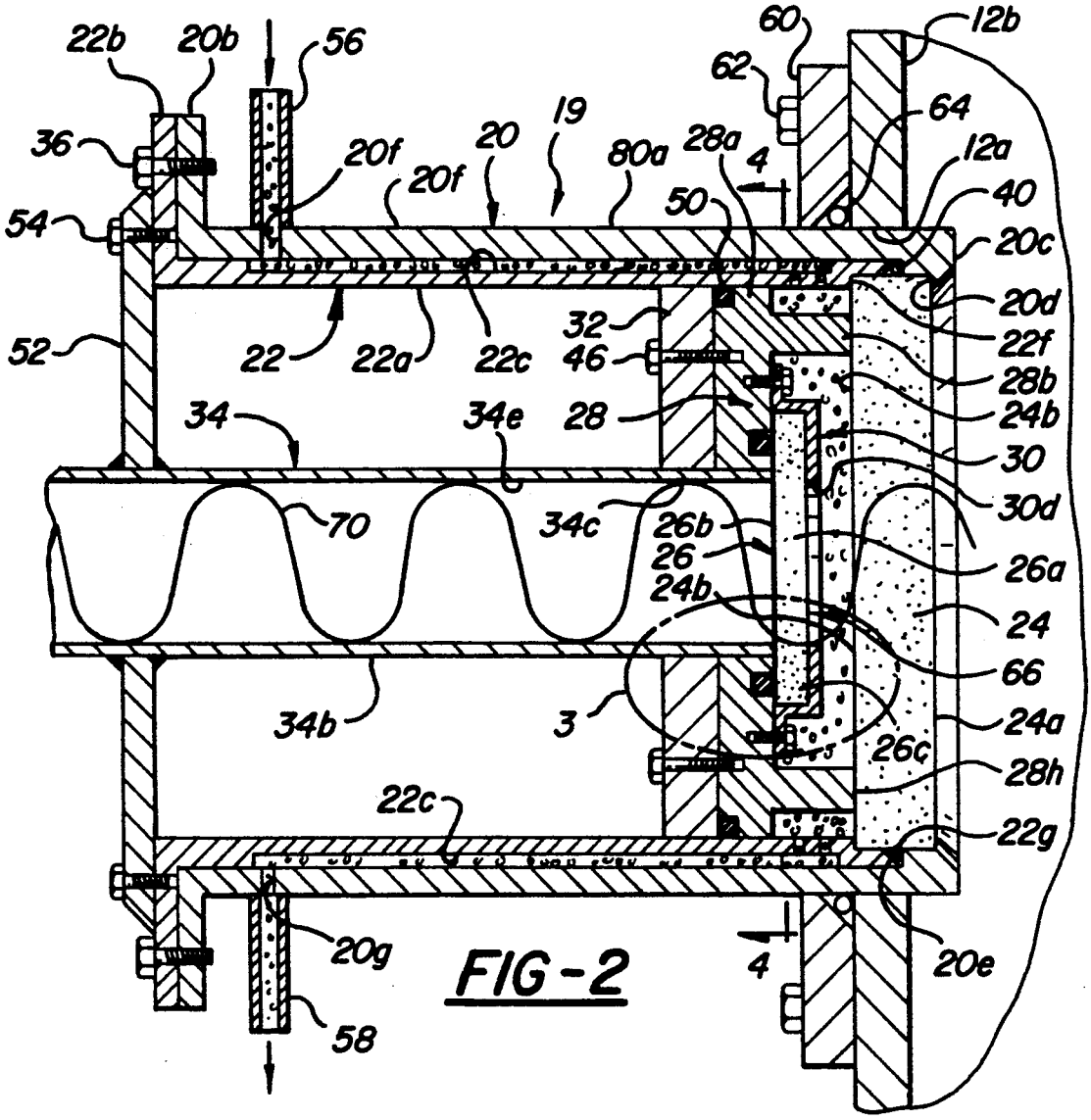
FIG. 2 is a cross-sectional view of the invention window assembly.
Figure 5:
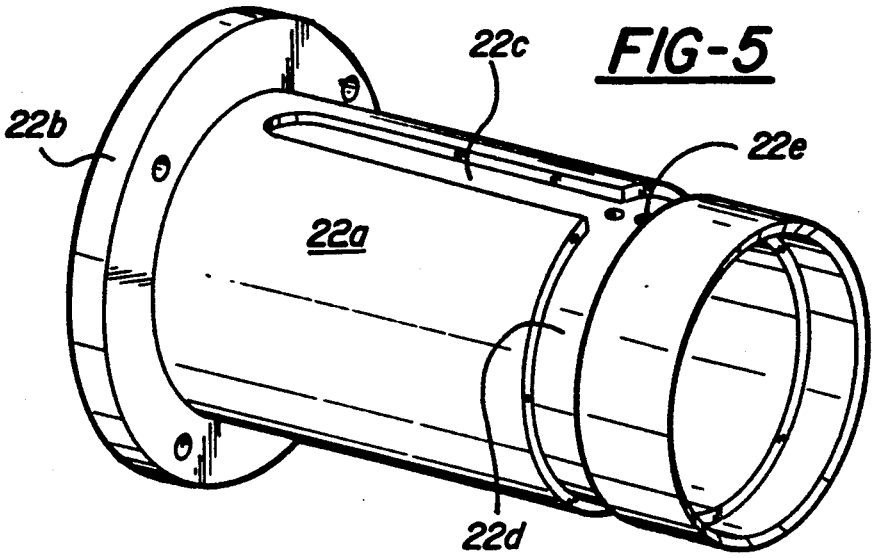
FIG. 5 is a perspective view of an inner sleeve utilized in the invention window assembly.
Figure 4:
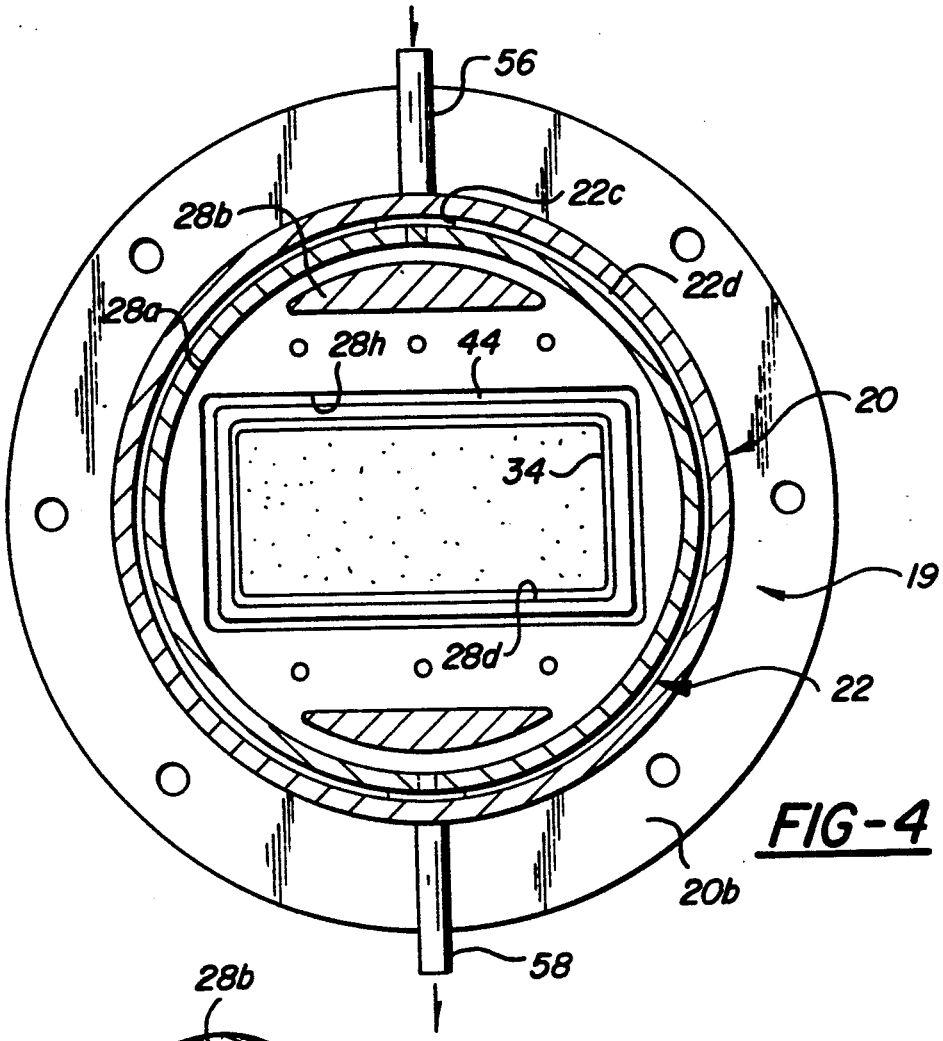
FIG. 4 is a cross-sectional view taken on line 4—4 of FIG. 2.
Figure 6:
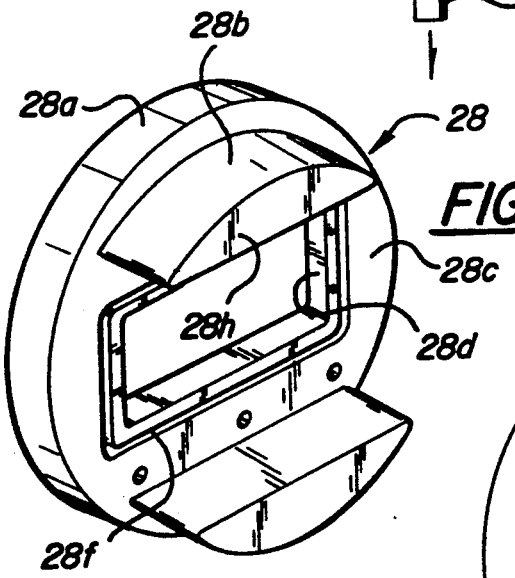
FIGS. 6, 7, 8 and 9 are detail views of a seal plate utilized in the invention window assembly.
Figure 7:
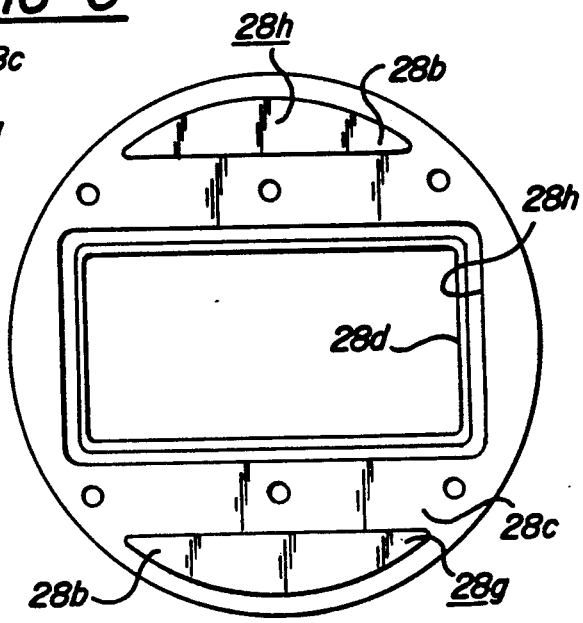
Figure 8:
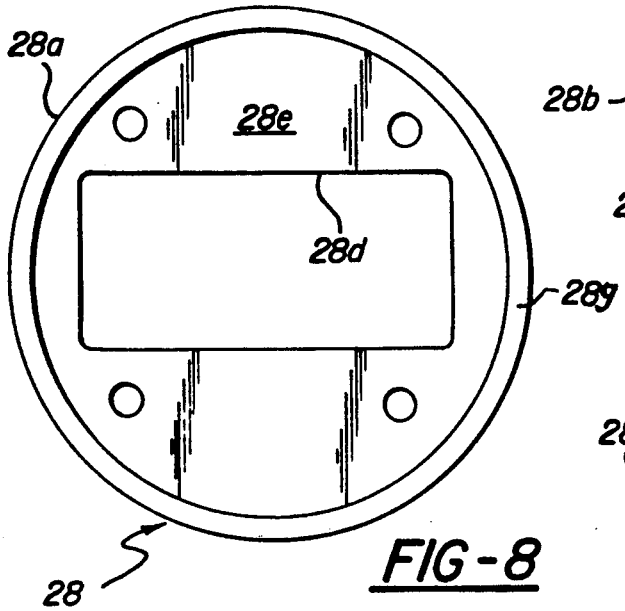
Figure 9:
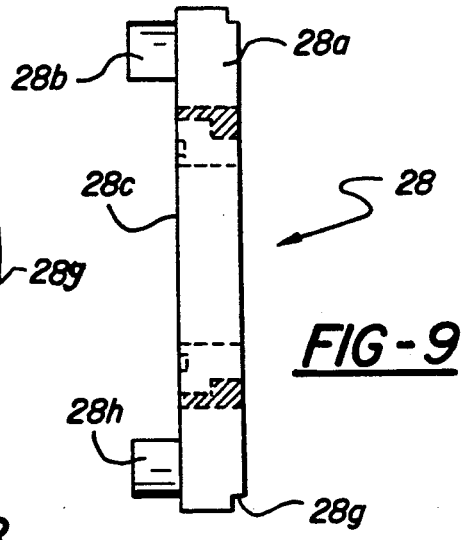
Figure 10:
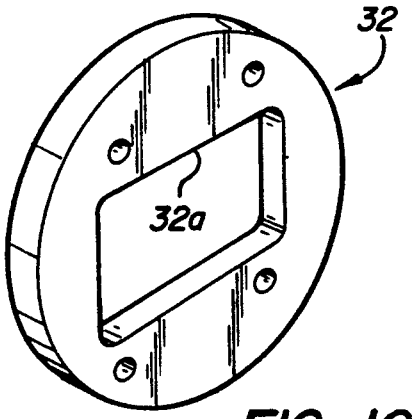
FIGS. 10 and 11 are detail views of a support plate utilized in the invention window assembly.
Figure 11:
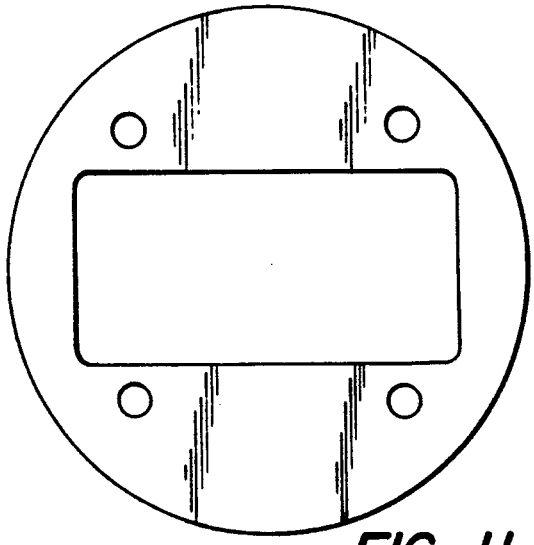
Figure 12:
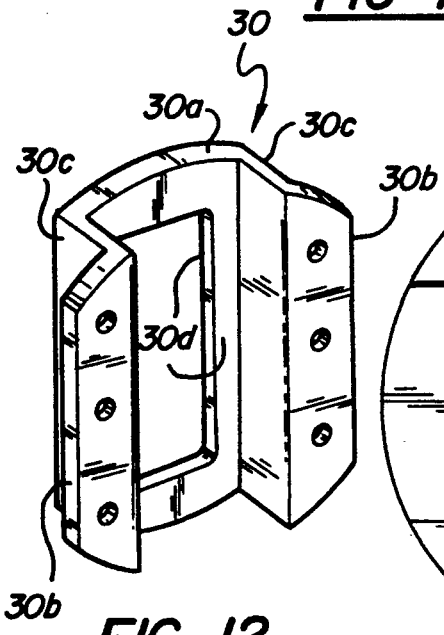
FIGS. 12, 13 and 14 are detail views of a clamp plate utilized in the invention window assembly.
Figure 13:
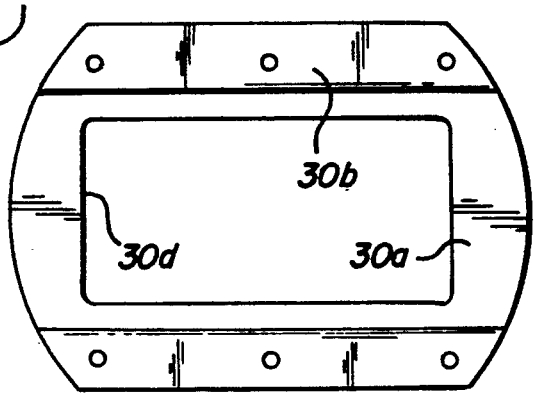
Figure 14:
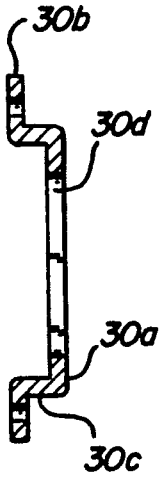

The microwave deposition apparatus, as seen in FIG. 1, includes microwave propagating means 10, a vacuum chamber 12, and a window assembly 14.

Microwave propagating means 10 is of known form and includes a microwave energy source 16 and an antennae probe 18. Source 16 may, for example, comprise a microwave frequency magnetron having an output frequency of, for example, 2.45 GHz.

Vacuum chamber 12, also of known form, is adapted to deposit successive layers of material, preferably amorphous semiconductor alloy materials, onto suitable substrate members in response to microwave energy introduced into the interior of the vacuum chamber via the invention window assembly 14.

The invention window assembly 14 includes a housing structure 19 constituted by a sleeve assembly including an outer sleeve 20 and an inner sleeve 22; a forward or primary window 24; a rearward or secondary window 26; a seal plate 28; a clamp plate 30; a support plate 32; and a waveguide tube 34.

Outer sleeve 20 is cylindrical and is formed of a suitable metallic material. Outer sleeve 20 includes a main body axially extending tubular portion **20*a*, a radially outwardly extending flange portion 20*b* at the rearward end of the sleeve, and a radially inwardly expending, flange portion 20*c* at the forward end of the sleeve. Sleeve main body portion 20*a* is received at its forward end in a suitable aperture 12*a* formed in a side wall 12*b* of vacuum chamber 12 so as to dispose forward flange 20*c* immediately inwardly of vacuum chamber side wall 12*b***.

Inner sleeve 22 is formed of a suitable metallic material and includes a main body axially extending tubular portion **22*a* and a rearward flange portion 22*b*. A pair of diametrically opposed axially extending grooves 22*c* are formed in the outer circumferential surface of main body portion 22*a*. Axial grooves 22*c* communicate at their forward ends with a circumferential groove 22*d* proximate the forward end of main body portion 22*a* and groove 22*d* in turn communicates with the interior of the sleeve via a plurality of radial ports 22*e*. Inner sleeve 22 is sized to fit snugly and telescopically within outer sleeve 20 with grooves 22*e* and 22*d* coacting with the confronting inner surfaces of the main body portion 20*a* of the outer sleeve to define passages or channels between the inner and outer sleeves. A plurality of bolts 36 secure outer sleeve flange portion 20*b* to inner sleeve flange portion 22*b*** to fixedly maintain the sleeves in their telescopic relation.

Primary or forward window 24 is formed of a suitable dielectric material substantially transparent to microwave energy and has a generally cylindrical configuration. Window 24 is positioned proximate the forward ends of the inner and outer sleeves within opening **12*a* in vacuum chamber side wall 12*b* with the forward surface 24*a* of the window positioned at its peripheral edge against the rearward surface 20*d*** of outer sleeve flange portion 20c and the rearward surface 24b of the window positioned at its peripheral edge against an annular shoulder 22f defined proximate the forward end of the main body portion 22a of the inner sleeve. The extreme forward edge of the inner sleeve is chamfered at 22g and acts to sealingly squeeze an annular sealing member 40 against the outer periphery of window 24 and against a rearwardly facing annular shoulder 20e defined by outer sleeve 20.

Secondary or rear window 26 is also formed of a suitable dielectric material substantially transparent to microwave energy, has a substantially rectangular configuration, and has a thickness significantly less than the thickness of primary window 24. For example, primary window 24 may have a thickness of ½ inch and secondary window 26 may have a thickness of ¼ inch.

Seal plate 28 is formed of a suitable metallic material and has a generally cylindrical configuration sized to fit slidably within inner sleeve 22. Seal plate 28 includes a main body cylindrical portion 28a and a pair of diametrically opposed spacer portions 28b extending forwardly from the front surface 28c of the seal plate. A rectangular window opening 28d extends through main body portion 28a from rear surface 28e to front surface 28c and an annular rectangular seal groove 28f is provided in forward surface 28c in surrounding relation to window opening 28d. A further circular groove 28g is provided proximate the outer rearward edge of main body portion 28a. Seal plate 28 is positioned within inner sleeve 22 with the outer periphery of the plate contiguous with the inner periphery of main body portion 22a of the inner sleeve and with the forward surfaces 28h of the spacer portions 28b abutting against the rear surface 24b of primary window 24 to space the seal plate rearwardly from the primary window by a distance corresponding to the length of the spacer portions 28b.

Clamp plate 30 is formed of a suitable metallic material and has a generally rectangular configuration. Plate 30 includes a main body portion 30a and upper and lower flange portions 30b connected to main body portion 30a by web portions 30c. A rectangular window opening 30d is formed in clamp plate main body portion 30a. Clamp plate 30 is secured to the front surface 28c of seal plate 28 by a plurality of bolts 42 with the secondary window 26 positioned within flange portions 30b so as to clamp the window between seal plate 28 and clamp plate 30. Specifically, the front surface 26a of the window 26 is positioned against the rear surface of clamp plate main body portion 30a and the rear surface 26b of window 26 is positioned against the forward surface 28c of seal plate 28 with an annular elastomeric sealing member 44 positioned in seal plate annular groove 28f sealingly engaging the confronting outer annular portion of the rear surface 26b of window 26.

Support plate 32 has a generally cylindrical configuration and fits slidably within inner sleeve main body portion 22a. Support plate 32 includes a central rectangular window opening 32a conforming in size and shape to the window opening 28d in seal plate 28. The forward surface 32b of support plate 32 is positioned against the rearward surface 28e of seal plate 28 by a plurality of bolts 46 passing through plate 32 for threaded engagement with threaded bores in the rear surface of the seal plate with an elastomeric seal 50 positioned in seal plate groove 28g to sealingly engage the inner periphery of inner sleeve 22.

Waveguide 34 is formed of a suitable metallic material and has a rectangular cross-sectional configuration that is uniform throughout the length of the waveguide. Waveguide 34 includes a first portion 34a extending from microwave energy source 10 and a second portion 34b extending axially and centrally into inner sleeve 22 with its forward end portion 34c passing through aligned rectangular openings 32a and 28d in support plate 32 and seal plate 28, respectively, to abut the forward annular rectangular edge 34d of the waveguide tube against the rear surface 26b of secondary window 26. The inner peripheral surface 34e of the waveguide tube has a size and cross-sectional configuration precisely conforming to the size and cross-sectional configuration of window opening 30d of clamp plate 30 so that the surface defined by window opening 30d in effect forms a forward extension of the surface defined by the inner surface 34e of waveguide tube 34. Waveguide 34 is secured to sleeves 20/22 via an annular flange 52 welded to the outer periphery of the waveguide tube and secured by bolts 54 to the rear flange portion 22b of the inner sleeve.

An entry tube 56 extends radially outwardly from main body portion 20a of outer sleeve 20 proximate rear flange 20b; a discharge tube 58 extends radially outwardly from main body portion 20a of outer sleeve 20 in generally diametrically opposed relation to tube 56; and an annular flange 60 is secured to the side wall 12b of the vacuum chamber 12, in surrounding relation to outer sleeve 20, by a plurality of bolts 62 with an annular sealing member 64 positioned in the crotch defined between flange 60, outer sleeve 20, and side wall 12b.

It will be seen that the tubes 56 and 58 coact with inner sleeve grooves 22c and 22d to define a path for delivering a cooling fluid, such as water, to the space 66 between the windows 24,26 and for removing fluid from the space so as to provide a continuous circulation of cooling fluid past the rearward surface of window 24. Specifically, cooling fluid enters through tube 56, passes through bore 20f in outer sleeve 20 and into upper groove 22c, passes axially forwardly between the sleeves in upper groove 22c to circumferential groove 22d, passes radially inwardly through ports 22e into space 66, passes downwardly in space 66 past the rearward surface of window 24, passes radially downwardly through further ports 22e into the lower portion of circumferential groove 22d, passes axially rearwardly in lower groove 22c, and is then discharged through outer sleeve bore 20g and through discharge tube 58.

It will further be seen that the inner surface 34e of waveguide tube 34 forms a waveguide surface portion extending from energy source 10 to the rear surface 26b of window 26 and that the periphery of window opening 30d of clamp plate 30 forms a further waveguide surface portion constituting a forward extension of the waveguide surface portion defined by waveguide tube 34.

It will further be seen that window 26 extends radially outwardly beyond the waveguide surface defined by tube 34 and window opening 30d to define an annular outer window portion 26c outwardly of the waveguide surface and that the annular elastomeric seal 44 engages the rear surface of this annular outer portion 26c of the window 26 so that the sealing occurs at a location that is removed from the waveguide surface defined by the coaction of the inner periphery of waveguide tube 34 and window opening 30d.

It will further be understood that the microwave energy 70 employed in the invention apparatus typically has a wave length of approximately five inches so that the microwave energy moving down the waveguide surface defined by the waveguide tube is unaware of the ½ inch gap in the waveguide surface defined by the window 26. As a result, the microwave energy 70 moves with a constant size and form from the microwave energy source 10 to the forward end of the waveguide surface as defined by the forward end edge of window opening 30*d*. Since the forward end edge of window opening 30*d* is only slightly spaced rearwardly from the rear surface 24*b* of primary window 24, for example by ½ inch, the microwave energy is maintained substantially intact in terms of size and shape from the microwave energy source to the rear surface of the primary window 24 so that the microwave energy passes through the window 24 and into the interior of the vacuum chamber substantially intact with respect to size and shape. As a result, the efficiency of the deposition/etching operation taking place within the vacuum chamber in response to the microwave energy is minimally deprecated by derogation in the form and size of the microwave's energy and the microwave energy is effectively precluded from access to the elastomeric seal 44 so that the problem of dealing with capacitive charges created at the seal by promiscuous microwave energy is substantially eliminated and so that, accordingly, an inexpensive elastomeric seal can be used in place of the expensive and exotic seals employed of necessity in the prior art devices.

The invention microwave window assembly will thus be seen to allow the use of spaced double windows in the window assembly to avoid heating and failure of the primary window without derogating the size and shape of the microwave energy as it enters the vacuum chamber through the window and without necessitating the use of expensive and exotic seals to combat promiscuous microwave energy movement resulting from the spaced dual window construction.

Whereas a preferred embodiment of the invention has been illustrated and described in detail, it will be apparent that various changes may be made in the disclosed embodiment without departing from the scope or spirit of the invention.

I claim:

1. A microwave window assembly for transmitting high power microwave energy from microwave propagating means into the interior of a chamber and including first and second windows formed of a dielectric material substantially transparent to microwave energy with the first window adapted to be sealed in a wall of the chamber and the second window spaced rearwardly from the first window to define a space therebetween, means for circulating a cooling fluid in the space between the windows, and means defining an axially extending waveguide surface for transmitting the microwave energy from the propagating means to the window assembly, characterized in that the waveguide surface includes a first waveguide portion comprising a closed surface of substantially uniform cross section extending from a location rearwardly of the second window to a location proximate the rearward surface of the second window and a second waveguide portion corresponding in size and cross-sectional configuration to said first portion extending from the forward surface of the second window and into said space toward the rearward surface of said first window, said second waveguide portion terminating at a location spaced rearwardly from the rearward surface of said first window so as not to interfere with the circulation of cooling fluid between the windows.

2. A microwave window assembly for transmitting high power microwave energy from microwave propagating means into the interior of a chamber and including first and second windows formed of a dielectric material substantially transparent to microwave energy with the first window adapted to be sealed in a wall of the chamber and the second window spaced rearwardly from the first window to define a space therebetween, means for circulating a cooling fluid in the space between the windows, and means defining an axially extending waveguide surface for transmitting the microwave energy from the propagating means to the window assembly, characterized in that the waveguide surface includes a first waveguide portion comprising a closed surface of substantially uniform cross section extending from a location rearwardly of the second window to a location proximate the rearward surface of the second window and a second waveguide portion corresponding in size and cross-sectional configuration to said first portion extending from the forward surface of the second window and into said space toward the rearward surface of said first window, said second window extending radially outwardly beyond the waveguide surface to define an annular outer window portion outwardly of the waveguide surface and the window assembly including annular sealing means which coact with said annular window portion to seal the interior of the waveguide surface from the circulating cooling fluid.

3. A window assembly according to claim 2 wherein the window assembly includes means defining an annular groove confronting a side surface of the annular window portion and said sealing means comprises an elastomeric annular seal received in the annular groove and sealingly engaging said side surface of the annular window portion.

4. A window assembly according to claim 3 wherein said window assembly includes a housing structure mounting the first and second windows and a seal plate positioned within the housing structure rearwardly of the second window and said annular groove is defined in the forward surface of said seal plate.

5. A microwave window assembly for transmitting high power microwave energy from microwave propagating means into the interior of a chamber and including first and second windows formed of a dielectric material substantially transparent to microwave energy with the first window adapted to be sealed in a wall of the chamber and the second window spaced rearwardly from the first window to define a space therebetween, means for circulating a cooling fluid in the space between the windows, and means defining an axially extending waveguide surface for transmitting the microwave energy from the propagating means to the window assembly, characterized in that the waveguide surface includes a first waveguide portion comprising a closed surface of substantially uniform cross section extending from a location rearwardly of the second window to a location proximate the rearward surface of the second window and a second waveguide portion corresponding in size and cross-sectional configuration to said first portion extending from the forward surface of the second window and into said space toward the rearward surface of said first window, said window assembly further including an annular clamp plate positioned against the forward surface of said second window and including a central window opening defining said second waveguide surface portion.

6. A window assembly according to claim 5 wherein said second window extends radially outwardly beyond the waveguide surface to define an annular outer window portion outwardly of the waveguide surface and said window assembly further includes a housing structure mounting the first and second windows and enclosing said clamp plate, an annular seal plate positioned within said housing structure against the rear surface of said annular outer window portion and defining an annular groove confronting the rear surface of said annular outer window portion, and an annular elastomeric seal positioned in said groove and sealingly engaging the rear surface of said annular window portion.

7. A window assembly according to claim 6 wherein said seal plate includes a central window and said first waveguide portion is defined by a waveguide tube passing through the central window of said seal plate for positioning against the rear surface of said second window.

8. A window assembly according to claim 7 wherein said housing structure includes inner and outer telescopically arranged sleeves and said means for circulating a cooling fluid includes means defining a cooling fluid path extending axially between said sleeves and communicating at its forward end with said space.

9. A window assembly according to claim 8 wherein said cooling fluid path includes first and second path portions communicating with said space respectively at generally diametrically opposed locations so as to allow the delivery of cooling fluid to said space through one path portion and the removal of cooling fluid from said space through the other path portion.

10. A microwave window assembly for transmitting high power microwave energy from microwave propagating means into the interior of a chamber and including first and second spaced windows formed of a dielectric material substantially transparent to microwave energy, means for circulating a cooling fluid between the windows, and means defining a waveguide surface for transmitting the microwave energy from the propagating means to the windows, characterized in that:

the waveguide surface comprises a closed surface of substantially uniform cross section extending from a first point remote from the windows forwardly to a second point proximate the windows;

one of the windows is positioned between the first and second points of the waveguide surface with its outer periphery extending outwardly beyond the waveguide surface to define a rearward waveguide portion extending rearwardly from the rear surface of said one window and a forward waveguide portion extending forwardly from the forward surface of said one window and to further define an annular window portion outwardly of the waveguide surface; and the window assembly further includes annular sealing means which coact with said annular window portion to seal the interior of the waveguide surface from the circulating cooling fluid.

11. A microwave window assembly for transmitting high power microwave energy from microwave propagating means into the interior of a chamber and including first and second spaced windows formed of a dielectric material substantially transparent to microwave energy, means for circulating a cooling fluid between the windows, and means defining a waveguide surface for transmitting the microwave energy from the propagating means to the windows, characterized in that:

the waveguide surface comprises a closed surface of substantially uniform cross section extending from a first point remote from the windows forwardly to a second point proximate the windows;

one of the windows is positioned between the first and second points of the waveguide surface with its outer periphery extending outwardly beyond the waveguide surface to define a rearward waveguide portion rearwardly of the rear surface of said one window and a forward waveguide portion forwardly of the forward surface of said one window and to further define an annular window portion outwardly of the waveguide surface; and the window assembly further includes annular sealing means which coact with said annular window portion to seal the interior of the waveguide surface from the circulating cooling fluid;

said first window being adapted to be positioned in the wall of the chamber, said second window being positioned rearwardly of said first window, and said one window comprising said second window.

12. A window assembly according to claim 11 wherein said window assembly further includes a tubular axially extending housing structure, said windows are mounted within said housing structure, and said window assembly further includes an annular seal plate and an annular clamp plate respectively positioned against the rearward and forward surfaces of said second window to clamp the second window therebetween.

13. A window assembly according to claim 12 wherein the annular sealing means comprises an annular seal groove in said seal plate and an annular elastomeric seal positioned in said groove and sealingly engaging the rear surface of said annular window portion.

14. A window assembly according to claim 13 wherein said clamp plate includes a window and said window defines said forward waveguide surface portion.

15. A microwave window assembly for transmitting high power microwave energy from microwave propagating means into the interior of a chamber and including forward and rearward spaced windows formed of a dielectric material substantially transparent to microwave energy, means for circulating a cooling fluid between the windows, and means defining a waveguide surface for transmitting the microwave energy from the propagating means to the windows, characterized in that the waveguide surface comprises a first closed portion extending forwardly up to the rear surface of said rearward window and a second closed portion of identical size and cross-sectional configuration to said first portion extending forwardly away from the forward surface of said rearward window and coacting with said first portion to define a closed waveguide surface of uniform cross section extending from a point on one side of said rearward window to a point on the other side of said rearward window but spaced rearwardly from the rearward face of said rearward window but spaced rearwardly from the rearward face of said forward window so as not to interfere with the circulation of cooling fluid between the windows.

16. A window assembly for transmitting high power microwave energy from microwave propagating means into the interior of a chamber and including first and second spaced windows formed of a dielectric material substantially transparent to microwave energy, means for circulating a cooling fluid between the windows, and means defining a waveguide surface for transmitting the microwave energy from the propagating means to the windows, characterized in that the waveguide surface comprises a first closed portion extending forwardly up to the rear surface of one of the windows and a second closed portion of identical size and cross-sectional configuration to said first portion extending forwardly away from the forward surface of said one window and coacting with said first portion to define a closed waveguide surface of uniform cross section extending from a point on one side of said one window to a point on the other side of said one window, said assembly further including an annular seal engaging an annular surface on one of said side surfaces of said one window at a location radially outwardly of said waveguide surface.

17. A window assembly for transmitting high power microwave energy from microwave propagating means into the interior of a chamber, said window assembly including:

an outer axially extending sleeve;

an inner axially extending sleeve sized to be positioned telescopically within said outer sleeve to form a sleeve assembly;

a window formed of a dielectric material substantially transparent to microwave energy positioned transversely within the sleeve assembly proximate one end of the sleeve assembly; and a waveguide communicating at one end thereof with the microwave propagating means and extending therefrom into the other end of the sleeve assembly to position the other end of the waveguide proximate the window.

18. A window assembly according to claim 17 wherein said window comprises a first window and said window assembly further includes a second window formed of a dielectric material substantially transparent to microwave energy positioned transversely within the sleeve assembly in proximate but spaced relation to the first window and means defining a cooling fluid path extending between the inner and outer sleeves and thence between the first and second windows.

19. A window assembly according to claim 18 wherein the cooling fluid path extends from an entry location axially between the inner and outer sleeves, thence transversely between the windows, and thence axially between the inner and outer sleeve to a discharge location.

20. A window assembly according to claim 17 wherein said waveguide defines a first closed waveguide surface of uniform cross section extending from said microwave propagating means forwardly to the rear surface of said window and said window assembly further includes means defining a second closed waveguide surface identical in cross section and size to said first waveguide surface and extending forwardly from the forward surface of said window towards said one end of said tube assembly.

21. A window assembly according to claim 20 wherein said assembly further includes an annular seal engaging one of said side surfaces of said window at an annular location positioned radially outwardly of said waveguide surfaces.

* * * * *

UNITED STATES PATENT AND TRADEMARK OFFICE

CERTIFICATE OF CORRECTION

PATENT NO. : 5,200,722

DATED : April 6, 1993

INVENTOR(S) : David Wolf

It is certified that error appears in the above-identified patent and that said Letters Patent is hereby corrected as shown below:

Column 7, Line 6, Delete "1/2" Insert --1/4--

Column 9, Line 37, after "a" delete "microwave"

Column 9, Line 64, after "a" delete "microwave"

Column 10, Line 44, after "a" delete "microwave"

Column 10, Line 62, after "window" delete "but spaced rearwardly from the rearward face of said rearward window"

Signed and Sealed this

Twenty-first Day of December, 1993

*Attest:*

*Attesting Officer*

Bruce Lehman

BRUCE LEHMAN

*Commissioner of Patents and Trademarks*